United States Patent [19]

Otting et al.

[11] Patent Number: 4,574,413

[45] Date of Patent: Mar. 11, 1986

[54] METHODS AND APPARATUS FOR EMPLOYING ELECTRICAL CONDUCTIVITY FOR FIXING DYE TO CARPETS

[75] Inventors: David L. Otting; Billy J. Otting, both of LaFayette; Robert B. Putney, Kensington, all of Ga.

[73] Assignee: Otting International, Inc., LaFayette, Ga.

[21] Appl. No.: 712,338

[22] Filed: Mar. 14, 1985

Related U.S. Application Data

[63] Continuation of Ser. No. 521,390, Aug. 8, 1983, abandoned.

[51] Int. Cl.[4] ..... D06P 5/20

[52] U.S. Cl. ..... 8/149.1; 8/151; 8/444; 34/1; 68/5 D; 118/620; 219/10.61 R; 219/10.81

[58] Field of Search ..... 8/444, 149.1, 149.2, 8/149.3; 68/5 D, 5 E, 13 R; 34/1; 219/10.61 R, 10.81; 118/620; 427/45.1, 49

[56] References Cited

U.S. PATENT DOCUMENTS

| | | | |
|---|---|---|---|
| 1,435,886 | 11/1922 | Acton et al. . | |
| 1,624,029 | 4/1927 | Whitcomb . | |
| 1,626,766 | 5/1927 | Tompkins | 34/1 |
| 2,390,572 | 12/1945 | De Brabander . | |
| 2,684,319 | 7/1954 | Arnold . | |
| 2,740,756 | 4/1956 | Thomas . | |
| 2,824,383 | 2/1958 | Machalek | 34/1 |
| 2,960,777 | 11/1960 | Doll | 34/1 |
| 2,972,196 | 2/1961 | Early et al. | 34/1 |
| 3,000,106 | 9/1961 | Christgau | 34/1 |
| 3,045,358 | 7/1962 | Breakell et al. . | |
| 3,057,075 | 10/1962 | Lippke . | |
| 3,096,161 | 7/1963 | Morrison et al. | 34/1 |
| 3,205,334 | 9/1965 | Manwaring | 34/1 |
| 3,230,861 | 1/1966 | Korr | 219/284 |
| 3,470,621 | 10/1969 | Bennett | 219/10.61 X |
| 3,484,179 | 12/1969 | Adams et al. | 34/1 |
| 3,492,460 | 1/1970 | Reich | 219/293 |
| 3,632,962 | 1/1972 | Cherniak | 219/284 |
| 3,761,670 | 9/1973 | Slaats et al. | 219/10.61 |
| 3,792,684 | 2/1974 | Janatka et al. | 118/620 |
| 3,859,494 | 1/1975 | Spengler | 34/1 |
| 3,878,619 | 4/1975 | Hodgett et al. | 34/1 |
| 3,894,410 | 7/1975 | Fleissner . | |
| 3,969,780 | 7/1976 | Henderson | 8/149.3 |
| 3,990,845 | 11/1976 | von der Eltz et al. | 8/149.3 |
| 3,994,683 | 11/1976 | Zimmer et al. | 8/444 |
| 4,017,258 | 4/1977 | Sando et al. . | |
| 4,104,019 | 8/1978 | Smith | 68/5 D X |
| 4,154,432 | 5/1979 | Janatka et al. | 118/620 |
| 4,242,805 | 1/1981 | De Angelis | 118/620 |
| 4,253,775 | 3/1981 | Crooks et al. | 118/620 |
| 4,274,209 | 6/1981 | Kawaguchi | 68/5 C |
| 4,303,820 | 12/1981 | Stottmann et al. | 219/10.81 |
| 4,304,048 | 12/1981 | Smith et al. | 34/1 |
| 4,365,422 | 12/1982 | Kawaguchi | 34/1 |
| 4,382,341 | 5/1983 | Bell et al. | 219/284 |
| 4,393,671 | 7/1983 | Ito | 219/10.55 |

FOREIGN PATENT DOCUMENTS

| | | | |
|---|---|---|---|
| 2052581 | 1/1981 | United Kingdom | 68/13 R |

*Primary Examiner*—Philip R. Coe

*Attorney, Agent, or Firm*—Kerkam, Stowell, Kondracki & Clarke

[57] ABSTRACT

Methods and apparatus for fixing dye to pile fabrics such as carpet material by employing the electrical conductivity of the wet carpet itself for the purpose of heating the carpet and dye to a temperature sufficient to fix the dye. The present apparatus, in the space of several feet along the length of a continuous carpet treating apparatus, performs the same function as a conventional carpet steamer, which is typically several hundred feet in length. In one specific form, the electric current is passed in a direction through the thickness of the carpet employing a pair of flat plate-like electrodes which contact the front and back surface of the carpet. In another specific form, the electric current is passed through the carpet in a direction generally parallel to a surface of the carpet, e.g. longitudinally, employing electrodes on the back surface of the carpet which do not disturb any pattern which may be printed on the carpet during the dyeing process. A dye fixing station employing electrical conductivity also may be employed in combination with a carpet steamer of conventional construction, but of greatly-reduced length, e.g., thirty feet.

43 Claims, 7 Drawing Figures

METHODS AND APPARATUS FOR EMPLOYING ELECTRICAL CONDUCTIVITY FOR FIXING DYE TO CARPETS

This is a continuation, of application Ser. No. 521,390, filed Aug. 8, 1983, and now abandoned.

BACKGROUND OF THE INVENTION

The present invention relates generally to methods and apparatus for fixing dye to pile fabrics such as carpet material, a process commonly known as steaming. More particularly, the invention relates to methods and apparatus employing the electrical conductivity of the wet carpet itself for the purpose of heating the carpet and dye to a temperature sufficient to fix the dye.

Carpet dyeing processes require at least two steps, done in sequence: (1) applying dye in liquid form to the carpet; and (2) fixing the dye to the carpet. It will be appreciated that "liquid form" is a general term, and includes foam, mist, and spray. Once the dye is fixed (or set) it becomes a stable and an essentially permanent part of the carpet fiber material.

Nearly universal conventional practice for fixing dye to carpet is to employ a steam chamber or oven, usually termed quite simply a "steamer". While known steamers take a variety of forms, typically they comprise an elongated chamber through which a web or length of carpet passes following dye application. In order to confine the steam with a minimum of loss, the elongated chamber is enclosed with slot-like openings at the entrance and egress for the carpet to pass through. Steam may be introduced either through a plurality of nozzles, a vat of boiling water below the path of the carpet, or a combination of both. The carpet may either pass straight through the steamer, or, by employing suitable guide rollers, may be guided in a serpentine path. Within the steamer, the carpet and dye are heated substantially uniformly to a sufficient temperature, with the presence of sufficient moisture, to cause fixation of the dye material to the carpet pile or nap. Generally, the boiling temperature of water at normal atmospheric pressure, i.e., 100° C., is sufficient for this purpose, although it may be noted that in some steamers a slightly higher pressure and thus temperature are employed. Following the steamer, the carpet is dried.

It will be appreciated, as is well known in the field of carpet dyeing, that, while dye fixation is a necessary step, a conventional carpet steamer is quite costly in a number of respects. One significant cost of operation is in energy inasmuch as a relatively large quantity of water must be heated to its boiling point temperature and, moreover, as a practical matter must be maintained at such temperature even during standby periods when carpet is not being run through the machine in order that the machine will be ready for each succeeding length of carpet. Adding to the cost of operation is the fact that a certain portion of the steam is necessarily lost to the process as a result of leakage, and thus never contributes to any useful purpose.

A conventional carpet steamer is also relatively expensive in terms of capital cost, both for the equipment itself and for the floor space required. Conventional steamers are typically one hundred fifty feet long, and thus use substantial amounts of floor space.

Despite these drawbacks, such steamers have long been conventional practice, which evidences the lack of any practical and acceptable alternative.

One alternative which has been proposed, although not specifically for carpet, is the use of microwave energy for fixing dyes to dyed textile materials. Such an approach is disclosed in Kawaguchi Pat. Nos. 4,274,209 and 4,365,422. Nevertheless, conventional steamers as summarized above have remained the standard for carpet dyeing purposes.

In the context of the present invention, it is pertinent to note that heating by electrical conductivity has been proposed for a variety of purposes. For example, U.S. Pat. Nos. 1,624,029 to Whitcomb, Tompkins 1,626,766, Malachek 2,824,383, Christgau 3,000,106 and Lippke 3,057,075 propose various apparatuses for heating and thus drying paper by electrical conductivity. The Malachek Pat. No. 2,824,383 also proposes the drying by electrical conductivity of various other types of wet porous sheets, such as leather, fabric and wood. None of these patents, however, suggest the use of electrical conductivity for fixing dye to carpet.

SUMMARY OF THE INVENTION

It is an important object of the invention to provide highly efficient and cost-effective apparatus and methods for fixing dye material to carpet, particularly in a continuous dye line.

It is another object of the invention to provide specific methods and apparatus employing electrical conductivity for fixing dye material to carpet.

Briefly, and in accordance with an overall concept of the invention, it is recognized that, by providing suitable apparatus, heating by electrical conductivity of wet carpet may effectively be employed to fix the dye to the carpet fibers. Substantial advantages result from the methods and apparatus of the invention.

Significantly, effective dye setting can be accomplished over a length of just several feet, in sharp contrast to the one hundred fifty foot length of a conventional steamer. Significant savings in energy costs are realized. It is presently estimated that the apparatus and method of the present invention result in an energy cost between one and two cents per yard of carpet, in sharp contrast to the five to eight cents per yard energy costs of conventional carpet steaming.

Moreover, the energy expenditure is automatically stopped when no wet carpet is present. Accordingly, substantial savings are realized during standby periods, and other periods of equipment down time compared to conventional steamers.

The system of the present invention does not completely dry out the carpet, inasmuch as, for effective dye setting, the carpet must be heated and maintained in a moist state. Thus, both in the case of a conventional steamer and in the case of the methods and apparatus of the present invention, the carpet subsequently passes through a drying unit. Nevertheless, following dye fixing employing the apparatus and methods of the present invention, the carpet has less moisture content than the following conventional steaming, thereby decreasing the energy requirements of the drying stage.

Briefly, and in accordance with one aspect of the invention, there is provided a method for fixing to wet carpet dye applied in liquid form to the carpet. The method comprises passing through the wet carpet an electric current of sufficient magnitude to cause heating of the carpet and dye to a temperature sufficient to fix the dye to the carpet. Typically, this temperature is the boiling point temperature of the liquid dye, which boiling point temperature is in the order of 100° C. An AC current is presently employed, although the invention is not so limited, and DC current may as well be employed.

In one specific form of the method, the electric current is passed in a direction through the thickness of the carpet employing a pair of flat plate-like electrodes which contact the front and back surfaces of the carpet. This is a highly efficient and presently preferred form where the carpet has been dyed with a solid (i.e. uniform) color where distortion of a pattern is thus not a factor. In another specific form, the electric current is passed through the carpet in a direction generally parallel to a surface of the carpet, e.g. longitudinally, employing electrodes on the back surface of the carpet which therefore do not disturb any pattern which may be printed on the carpet during the dyeing process.

While the methods of the invention may be employed to fix carpet dye a section at a time, in its preferred form the method of the invention involves a continuous process wherein a length of carpet is continuously transported from a dyeing station directly to and through a dye fixing station at which the electric current is passed through the carpet.

In accordance with another embodiment of the invention, a method for continuous treatment of a length of carpet material comprises the steps of sequentially wetting the carpet with a dye-compatible liquid at what is known in the art as a wet-out station, applying dye in liquid form to the carpet, and then passing through the wet carpet an electric current of sufficient magnitude to cause heating of the carpet and dye to a temperature sufficient to fix the dye to the carpet. Preferably, the method comprises the further step of ensuring that the dye-compatible wetting liquid and the liquid dye have sufficient electrical conductivity to pass the electric current. Typically, both the wetting liquid and the liquid dye are aqueous and include in the order of two grams per liter of a dissolved salt, such as ordinary sodium chloride, to enhance electrical conductivity.

In one form, the step of applying dye in liquid form to the carpet comprises applying dye substantially uniformly to produce a solid color, and step of passing through the wet carpet an electric current comprises passing electric current in a direction through the thickness of the carpet.

In another form of the method of the invention, the step of applying dye to the carpet comprises applying dye to the carpet to form a pattern, and the step of passing an electric current through the wet carpet comprises applying electric current to the back side of the carpet such that electric current flows in a direction generally parallel to the surface of the carpet, and the pattern is substantially undisturbed.

In accordance with another aspect of the invention, there is provided apparatus for fixing to wet carpet dye applied in liquid form to the carpet. The apparatus comprises at least a pair of electrodes disposed for electrically contacting the wet carpet and arranged for connection to an electric power source so as to pass through the wet carpet an electric current of sufficient magnitude to cause heating of the carpet and dye to a temperature sufficient to fix the dye to the carpet. Preferably, a three-phase AC power source is employed and there are at least three electrodes arranged for respective connection to the three phase conductors of the power source.

In one specific form, the electrodes are disposed for electrically contacting opposite surfaces of the carpet so as to pass electric current in a direction through the thickness of the carpet. More particularly, the electrodes comprise a horizontally-disposed plate-like lower electrode arranged for supporting and electrically contacting the carpet by the carpet back side, and a horizontally-disposed plate-like upper electrode opposite the lower electrode arranged for bearing against the front side of the carpet. The upper electrode is arranged to bear against the carpet with a force equivalent to a weight in the order of seven pounds per square foot. The upper electrode for convenience may comprise an aluminum plate in the order of one-half inch thick disposed so as to bear by the force of gravity on the carpet. Typically, the apparatus comprises a continuous carpet dyeing machine, and there is included a driving arrangement for continuously advancing a length of carpet past the electrodes.

In one embodiment, an upper plate support structure is provided and arranged to limit downward movement of the upper plate in the absence of carpet so as to prevent electrical contact between the upper and lower plates, and to permit freely floating vertical movement of the upper plate in the presence of carpets so as to maintain electrical contact of the upper plate with the carpet.

Advantageously, three-phase AC power is employed for efficient utilization of electrical capacity. For a typical three-phase delta-connected AC power source having three phase conductors $\phi_1$, $\phi_2$ and $\phi_3$, three (or a multiple of three) sets of electrodes are employed, each set comprising an upper electrode plate and a lower electrode plate. In an exemplary connection, the upper electrode plate of the first set is arranged for connection to the $\phi_1$ conductor, and the lower electrode plate of the first set is arranged for connection to the $\phi_2$ conductor. Next, the upper electrode plate of the second set is arranged for connection to the $\phi_2$ conductor, and the lower electrode plate of the second set is arranged for connection to the $\phi_3$ conductor. Finally, for the third set the upper plate is arranged for connection to the $\phi_3$ conductor and the lower plate is arranged for connection to the $\phi_1$ conductor.

A four-wire three-phase Y-connected AC power source having three phase conductors and a neutral conductor may also be employed. In this case, a single lower electrode is arranged for connection to the neutral conductor, and three individual upper electrodes are arranged for respective connection to the three phase conductors.

In another form, the electrodes are disposed for electrically contacting the back surface of the carpet so as to pass the electric current in a direction generally parallel to a surface of the carpet, e.g., longitudinally. In one specific form, closely-spaced elongated stationary electrodes are provided, spaced in the order of one-half inch apart. Preferably, these electrodes are embedded in a semi-cylindrical electrode support member over which the length of carpet is pulled.

In another form, a cylindrical roll of electrical insulating material is provided, with guides for bringing the back side of the carpet in contact with at least a portion of the cylindrical surface of the roll. Similar elongated electrodes are embedded at the cylindrical surface of the cylindrical roll parallel to the axis of the roll and spaced circumferentially from one another so as to pass the electric current in a direction generally parallel to a surface of the carpet. A roll drive is provided for rotating the cylindrical roll as the carpet is advanced, preferably in a direction and at a rotational velocity such that the cylindrical surface of the roll moves in the same direction as and in slightly faster than the carpet. A wiping action thus results.

Preferably, in either of these embodiments, at least three elongated electrodes are provided, with electrodes arranged for connection to a three-phase AC power source having three phase conductors. The three elongated electrodes are arranged for respective electrical connection to the three phase conductors.

If it is desired to employ a four-wire, three-phase Y-connected source while contacting the back side of the carpet only, a plurality of electrodes may be provided with every other electrode arranged for connection to the neutral conductor, and the intermediate electrodes arranged for respective connection to the individual phase conductors in sequence.

Briefly stated, and in accordance with another aspect of the invention, apparatus is provided for continuous treatment of the length of carpet. The apparatus comprises a wet-out station for wetting the carpet with a dye-compatible liquid, a dye applicator for applying dye in liquid form to the carpet. The dye applicator may be arranged so as to apply dye to the carpets substantially uniformly to produce a solid color, or may be arranged so as to apply dye to the carpet in a pattern.

The apparatus further comprises a dye fixing station including at least a pair of electrodes disposed for electrically contacting the wet carpet and arranged for connection to an electric power source so as to pass through the wet carpet and electric current of sufficient magnitude to cause heating of the carpet and the dye to a temperature sufficient to fix the dye to the carpet. This dye fixing station may take any of the forms summarized hereinabove.

Finally, the apparatus includes a driving arrangement for continuously advancing the length of carpet through the wet-out station, the dye applicator, and the dye fixing station.

The dye-compatible wetting liquid and the liquid dye have sufficient electrical conductivity to pass the electric current. Typically, both the wetting liquid and the liquid dye are aqueous, and include in the order of two grams per liter of a dissolved salt to enhance electrical conductivity.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DETAILED DESCRIPTION OF THE PREFERRED EMBODIMENT

Figure 1:
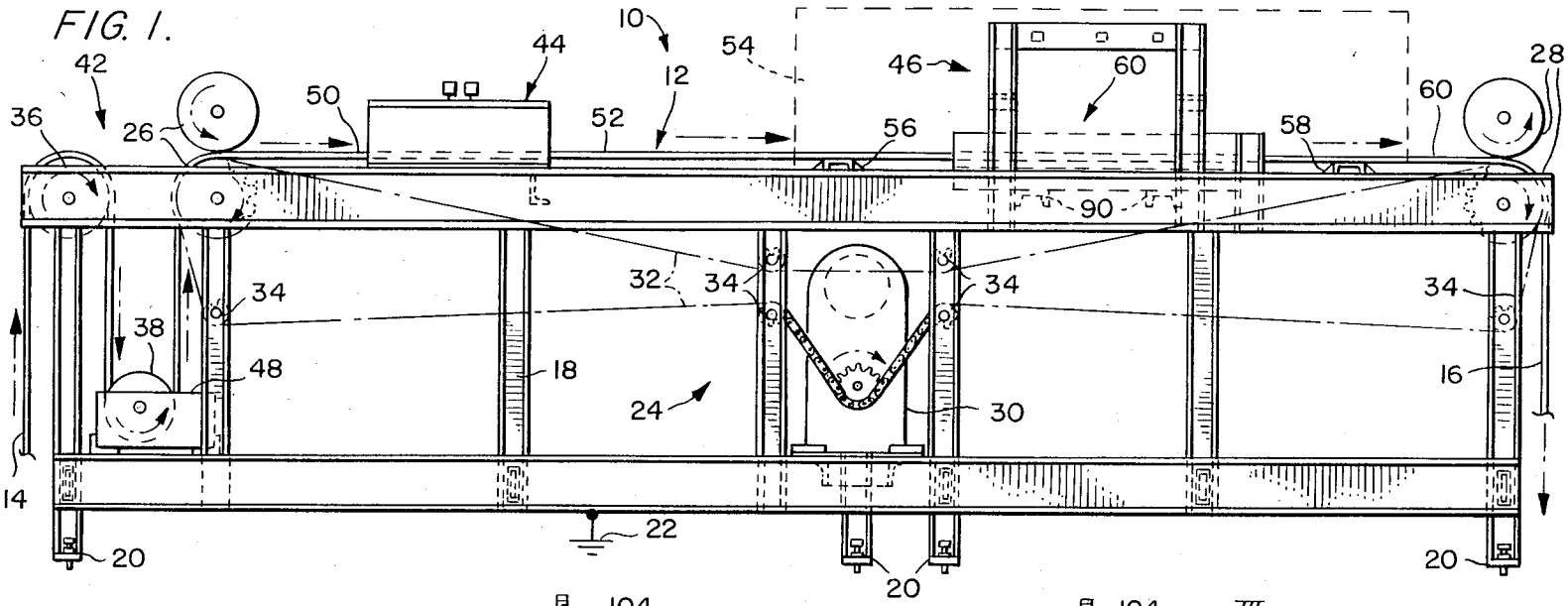
FIG. 1 is a side elevational view of an apparatus in accordance with the invention for continuous treatment of a length of carpet.

Referring now to the drawings, FIG. 1 is an overall view of apparatus 10 in accordance with the invention for continuous treatment of a length of carpet 12, which enters the apparatus 10 at 14 and exits at 16. In overview, the apparatus 10 comprises a suitable frame structure 18 securely fixed at mounting points 20 to a floor. For safety, the frame 18 is electrically grounded, as is schematically depicted at 22.

For continuously advancing or conveying the length of carpet 12 through the apparatus 10, a conventional driving arrangement, generally designated 24 is provided. In particular, the driving arrangment 24 includes nip roll pairs 26 and 28 driven by an electric motor and gear box arrangement 30 via a chain drive including a chain 32 and various idler sprockets 34. Various idler rolls such as rolls 36 and 38 support and guide the length of carpet 12 on its travel through the apparatus 10.

More particularly, the apparatus 10 includes, in sequence, a wet-out station generally designated 42, a dye applicator generally designated 44, and a dye fixing station 46, which dye fixing station 46 employs electrical conductivity.

The wet-out station 42 is a conventional one and comprises a trough-like tank 48 into which the carpet web 12 is dipped as the length of carpet 12 is advanced. As will be appreciated from FIG. 1, this is accomplished by the idler roller 38. The carpet is then squeezed between the pair 26 of nip rolls so as to wring out excess moisture.

The solution within the wet-out tank 48 is an aqueous solution and includes suitable dissolved wet-out agents as is known in the art. In the practice of the present invention, it is also important to control the conductivity of the wet-out solution in order that the wet carpet passing through the dye fixing station 46 has sufficient electrical conductivity. In some cases, an entirely conventional wet-out solution is sufficient. With others, it is necessary to add something else to the wet-out solution to enhance the electrical conductivity. One example is a salt. By way of example, and without intending to limit the scope of the invention, ordinary sodium chloride at a concentration of two grams per liter has been found to be satisfactory.

Any single substance or combination of substances whether gas, liquid or solid can be used which will adjust the conductivity of the dye liquor and/or wet-out liquor to the proper value. The correct conductivity will permit the correct amount of current to flow to heat the fabric to the desired temperature without undue waste and will depend on fabric weight, time of current flow and voltage.

Following the wet-out station 42, the length of carpet 12 travels at 50 to the dye applicator 44, which may comprise virtually any known type of dye applicator. The present invention is not directly concerned with the details of the dye applicator 44 itself, inasmuch as the present invention is capable of virtually universal application to carpet dyeing processes where it is desired to avoid the use of a conventional steamer for fixing the dye.

By way of example, the dye applicator 44 may comprise a jet printing and dyeing machine such as is disclosed in Otting U.S. Pat. No. 4,341,098, the entire disclosure of which is hereby expressly incorporated by reference. A related form of applicator, known as a "foam" applicator may be employed. A preferred foam applicator is one which mixes foam and air at nozzles to minimize the use of liquid dye solution while obtaining excellent coloring results. Such foam applicators are disclosed in Otting U.S. patent application Ser. No. 391,468 filed June 23, 1982, and Otting U.S. patent application Ser. No. 469,643 filed Feb. 25, 1983, the entire disclosures of which are also hereby incorporated by reference. Any of the dye applicators referred to above can be operated either as a pattern applicator wherein individual nozzles are controlled to produce a pattern effect, or as a solid color applicator wherein all nozzles uniformly apply a single color dye to the carpet 12.

Following the dye applicator 44, the length of carpet 12 travels at 52 to the dye fixing station 46. For safety, in view of the electric current and voltage employed, the fixing station 46 is suitably enclosed, such as by an insulative plexiglass hood 54. Additionally, safety grounding bars 56 and 58 traversing the width of the carpet 12 are provided at the entrance and exit of the carpet dyeing station 46 to electrically contact the back side of the carpet 12 to ensure that the carpet 12 is at electric ground potential when it is outside the dye fixing station 46.

The dye fixing station 46 of FIG. 1 includes an electrode arrangement, generally designated 60, and is described in greater detail hereinbelow with reference to FIGS. 2 and 3. Thereafter, alternative forms of dye fixing stations in accordance with the invention are described with reference to FIGS. 4–7.

However, at this point it may be noted in general, and as summarized hereinabove, that the dye fixing station 46 serves to fix the dye to the carpet 12 by passing through the wet carpet an electric current of sufficient magnitude to cause heating of the carpet and dye to a temperature sufficient to fix the dye to the carpet 12. It is pertinent to note that the dimension of the dye fixing station along the direction of carpet 12 travel is in the order of three to four feet, in sharp contrast to the several hundred foot length of a conventional carpet steamer. During operation, the carpet and dye are heated to the boiling point temperature of the dye solution, and a portion of the solution is vaporized to form steam. While the carpet 12 might also be dried in the dye fixing station 46, in normal operation such is not contemplated due to the possibility of damaging the carpet. Rather, the intention is to heat the carpet to a sufficient temperature and in the presence of sufficient moisture to properly fix the dye with the same results as in a conventional steamer.

Following the dye fixing station 46, the carpet travels as at 60 through the pair 28 of nip rolls which serve to pull the carpet 12 through the apparatus 10, and the carpet 12 then exits the apparatus 10 at 16.

Thereafter, the length of carpet 12 is transported through a conventional drying unit (not shown), possibly also, depending upon the particular dyeing process involved, preceded by a washer.

Figure 2:
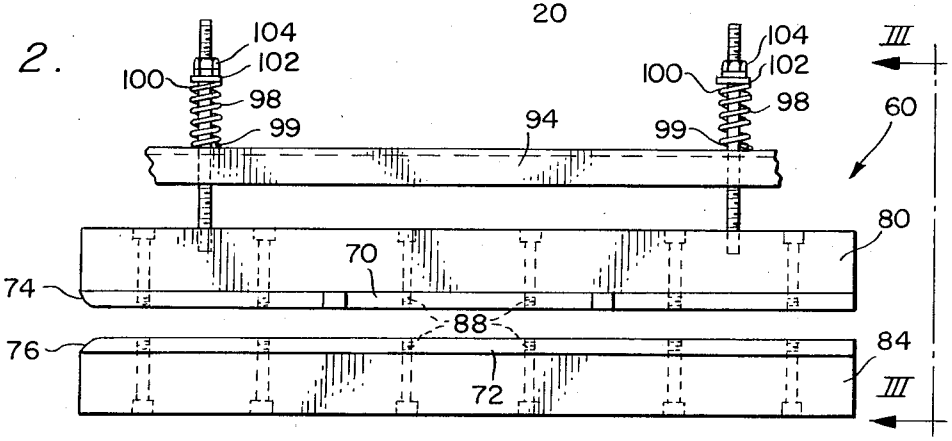
FIG. 2 is an enlarged side elevation of the dye fixing station of the FIG. 1 apparatus.
Figure 3:
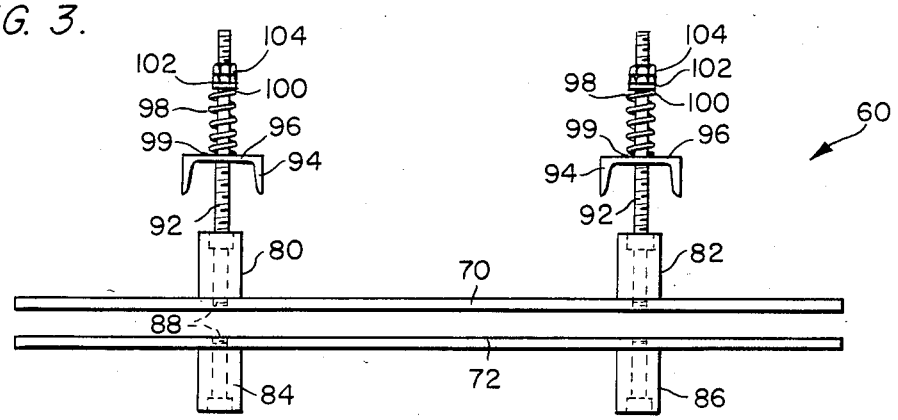
FIG. 3 is a view taken along line III—III of FIG. 2.

With reference now to FIGS. 2 and 3, shown in greater detail is the electrode arrangement 60 of the FIG. 1 dye fixing station 46. The orientation of the FIG. 2 view corresponds with that of FIG. 1, with the length of carpet 12 moving from left to right, while FIG. 3 is a view along line III—III of FIG. 2, with the direction of carpet travel being out of the paper in the FIG. 3 orientation.

In FIGS. 2 and 3, a pair of electrodes 70 and 72 are disposed for electrically contacting opposite surfaces of the carpet 12 as the carpet 12 is conveyed therebetween so as to pass the electric current in a direction through the thickness of the carpet. This has been found to be the most efficient mode of operation of the present invention. As will be seen in FIG. 2, for smooth entry the electrodes 70 and 72 have respective curved edges 74 and 76 at the point where carpet enters. By way of example, the dimension of the electrodes 70 and 72 along the direction of carpet travel as viewed in FIG. 2 is in the order of thirty inches. In the FIG. 3 view, the overall dimension of the electrodes 70 and 72 is whatever is necessary to accomodate the width of the carpet, typically twelve to fifteen feet.

The electrodes 70 and 72 are insulatively supported by a plurality of plastic bars, such as bars 80 and 82 supporting the upper electrode 70, and bars 84 and 86 supporting the lower electrode 72. These bars 80, 82, 84 and 86 in the illustrated embodiment run in the same direction as the path of carpet travel, although it will be appreciated that this is a matter of design choice. Also, although only two pairs 80, 84 and 82, 86 of insulating support bars are depicted in FIG. 3, it will be appreciated that this number will be increased depending upon the width of and the rigidity of the electrodes 70 and 72.

The electrodes 70 and 72 are secured to the insulating bars 80, 82, 84 and 86 by means of machine screws 88 suitably drilled and tapped into the insulating bars 80, 82, 84 and 86, but not extending all the way through.

The lower insulating support bars 84 and 86 are mounted to suitable U-beam supports 90 (FIG. 1) fixed to the frame 18 of the apparatus 10, while the upper insulating support bars 80 and 82 are connected via threaded rods 92 in a floating support structure arrangement. A pair of U-channel beams 94 are fixed to the frame 18 of the apparatus 10, and the threaded rods 92 loosely pass through apertures 96 in the U-channels 94 for free vertical movement. Compression springs 98 bear at their lower ends 99 against the U-channel 94. At the compression spring 98 upper ends 100, washers 102 and nuts 104 threaded to the rods 92 support the weight of the upper plate 70 and provide a means for adjustment.

The nuts 104 are adjustably positioned on the threaded rods 92 so as to limit downward movement of the upper plate 70 in the absence of carpet so as to prevent electrical contact between the upper and lower plates, and to permit freely floating vertical movement of the upper plate 70 in the presence of carpet so as to maintain electrica contact of the upper plate 70 with the carpet 12. Depending upon the stiffness of the springs 98, the entire weight of the upper plate 70 and a portion of the support structure comprising the insulating bars 80 and 82 and the threaded rods 92 can bear on the carpet 12. Alternatively, the springs 98 can support some of this weight, thereby decreasing pressure on the carpet.

The precise pressure may be selected in accordance with the characteristics of the particular carpet involved. However, as a guide, the force equivalent to a weight of seven pounds per square foot of area has been found suitable, and this is achieved simply by the weight of the upper plate 70 itself, where the upper plate 70 comprises a one-half inch thick aluminum plate.

While aluminum plates have been employed in the practice of the invention, conventionally the use of aluminum in carpet processing machinery is avoided due to potential staining of the carpet by aluminum corrosion products which occur particularly with the lower pH solutions involved in carpet processing. Accordingly, alternative electrode materials having higher but nevertheless acceptable electrical conductivity may be employed, such as stainless steel or bronze electrodes.

Figure 4:
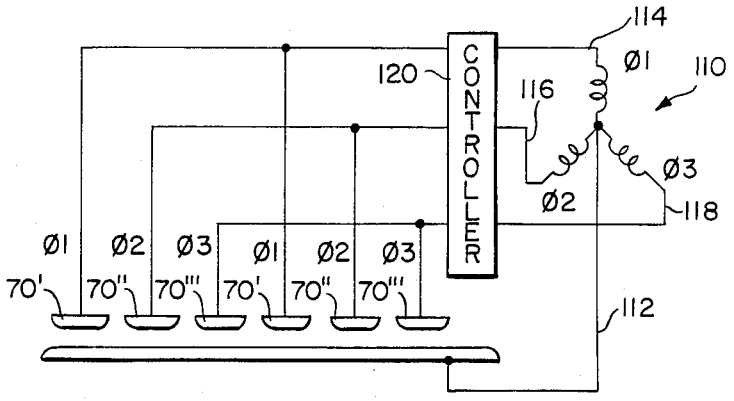
FIG. 4 is a schematic representation of a flat-plate form of electrode arrangement connected to a three-phase AC power source.

It will be appreciated that the electrode arrangement depicted in FIGS. 2 and 3 is suitable only for single-phase connection to a power source. As is well known, where high power is involved, three-phase supply arrangements are preferred for efficient utilization. Accordingly, as summarized hereinabove, three (or a multiple of three) sets of electrodes may be employed, each set comprising both an upper electrode plate and a lower electrode plate. The top electrode plates and the bottom electrode plates are connected in phase sequence, but the connections are staggered. Thus, an exemplary phase sequence for connection to the three top plates is $\phi_1$, $\phi_2$ and $\phi_3$, and an exemplary phase sequence for connection to the three bottom plates is $\phi_2$, $\phi_3$ and $\phi_1$.

Where a four-wire three-phase connection is desired, the arrangement of FIG. 4 may be employed. In particular, FIG. 4 is a highly schematic depiction of a three-phase flat-plate electrode arrangement comprising a single lower electrode 72 and at least three upper electrodes 70', 70'' and 70''' opposite the lower electrode 72. These electrodes are arranged for connection to a four-wire, three-phase Y-connected AC power source represented at 110. The lower electrode 72 is arranged for connection to the neutral conductor 112, while the upper electrodes 70', 70'', and 70''' are arranged for respective connection to the three phase conductors 114, 116, and 118.

While only three upper electrodes 70', 70'', and 70''' may be employed if desired, the phase sequence may be repeated in additional multiples of three electrodes, as shown.

Also schematically depicted in FIG. 4 is a controller 120 which may comprise any suitable form of controller for controlling the energization of the electrodes from the power source 110.

By way of example, and without limitation of the scope of the invention, the controller 120 may comprise a suitable voltage variable transformer arrangement, or it may comprise an interrupting type controller wherein energization is applied in pulses, with duty cycle control. Such an interrupting controller can comprise either an electronic controller employing, for example, thyristors such as SCR's or triacs, or may comprise suitable cam-operated mechanical switches operating at a repetition frequency in the order of 20 Hz and with a variable duty cycle.

Considering the specific power levels involved, for purposes of example, and not limitation, a typical carpet fixing apparatus operates from a 480 volt three-phase AC supply drawing in the order of 200 amperes from each phase. A power input of in the order of 100 kilowatts directly heats the wet carpet by electrical conductivity. While this represents a substantial rate of energy usage, it is nevertheless quite efficient compared to conventional carpet steamers because substantially all of the energy is going to directly heat the carpet and moisture content thereof, with minimal loss.

In operation, the process is somewhat self-regulating in that, as a given section of carpet passes through the electrodes 70 and 72 and moisture is removed, the electrical resistance of the carpet increases somewhat, causing the electrical current therethrough to decrease. Thus, while a relatively fixed amount of energy is applied to heat a given section of wet carpet as it passes between the plates 70 and 72, the power is inherently applied at a higher rate initially, thus more rapidly heating the carpet, and the power input then tapers off as a given section of carpet is about to exit the electrode 70 and 72.

It will be appreciated that the process is substantially continuous such that, at any given time, some individual sections of carpet are just entering the electrodes, while others are just exiting. Once the process is under way during a given production run, the rate of energy usage stabilizes.

Thus, while some form of electrical control is certainly necessary for the practice of the invention, one of the features of the invention is that the electrical controls need not be unduly complex due to the self-regulating nature of the process.

The flat-plate electrode arrangements for passing electric current through the thickness of the carpet as described hereinabove with reference to FIGS. 1–4 are highly efficient in delivering the energy to the wet carpet for heating by electrical conductivity. However, such flat-plate electrodes cannot be used in all circumstances, particularly where the dye applicator 44 is a pattern applicator. The reason for this is that, before the dye is fixed, the upper electrode 70 or multiple electrodes 70', 70'', 70''' tend to disturb the pattern.

Figure 5:
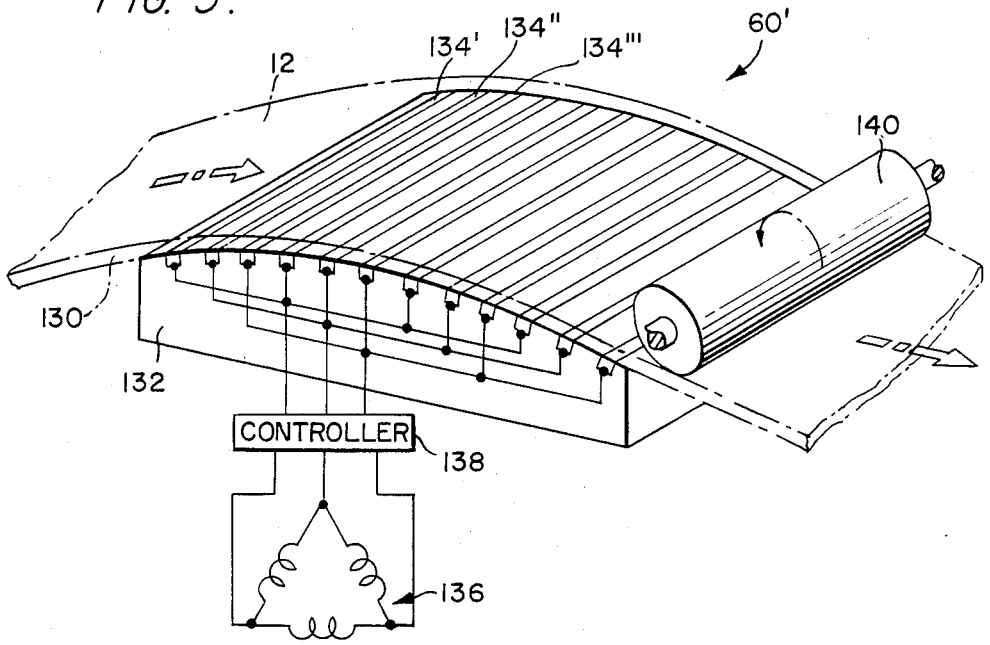
FIG. 5 is a highly schematic view of another form of electrode arrangement comprising closely-spaced fixed parallel bars contacting the back side of the carpet.

With reference now to FIG. 5, shown is an alternative form of electrode arrangement 60' which contacts the carpet 12 from the back side 130 thereof so as to pass the electric current in a direction generally parallel to a surface of the carpet, i.e., longitudinally. To accomplish this, the carpet is pulled over a slightly convex insulative electrode support 132 in which a plurality of elongated electrodes, such as bronze electrodes 134', 134'', and 134''' are embedded. These electrodes extend in a direction perpendicular to the path of the carpet travel, i.e., across the width of the length of carpet, and are spaced relatively closely, for example, one-half inch from each other. These electrodes are adapted for connection to respective phase conductors of a three-phase AC power source, represented at 136, through a suitable controller 138 which may be substantially identical to the controller 120 of FIG. 4.

To complete the FIG. 5 structure, an idler roller 140, contacting the upper surface of the carpet 12 is provided immediately electrodes 134', 134'', and 134'''.

As also summarized hereinabove, a four-wire, three-phase Y-connected source may be employed with a modification to FIG. 5 arrangement. In this modification, every other electrode is arranged for connection to the neutral conductor, with the intermediate electrodes arranged for respective connection to the individual phase conductors in sequence.

Figure 6:
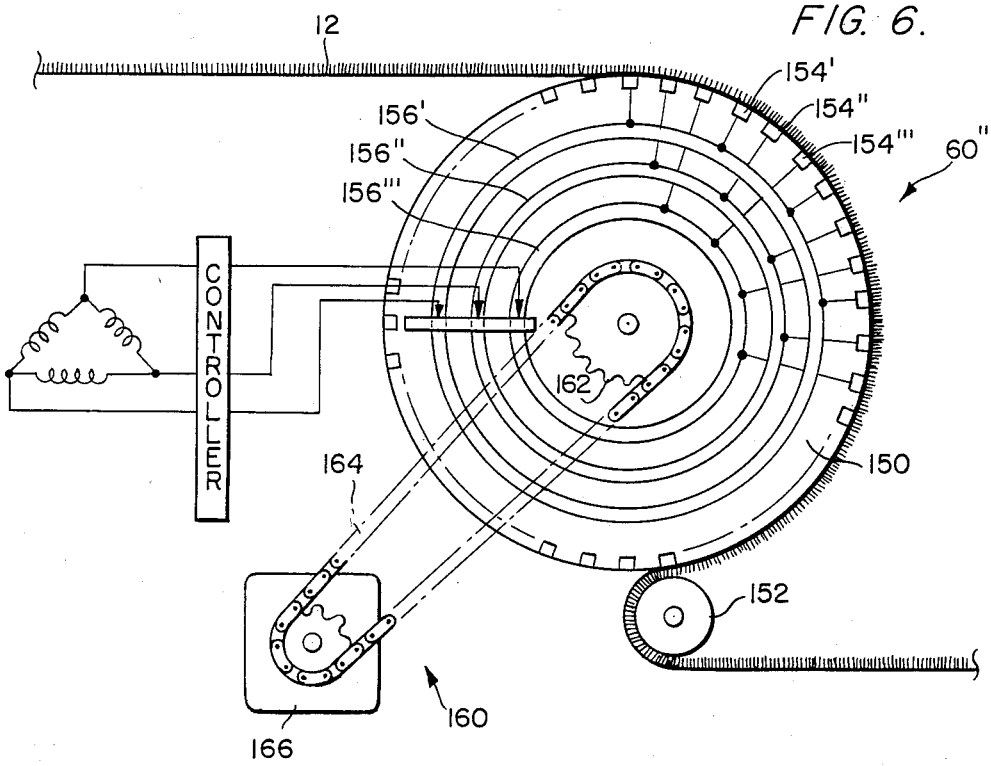
FIG. 6 is a modified form of the FIG. 5 embodiment wherein the parallel bars are carried by a rotating drum.
Figure 7:
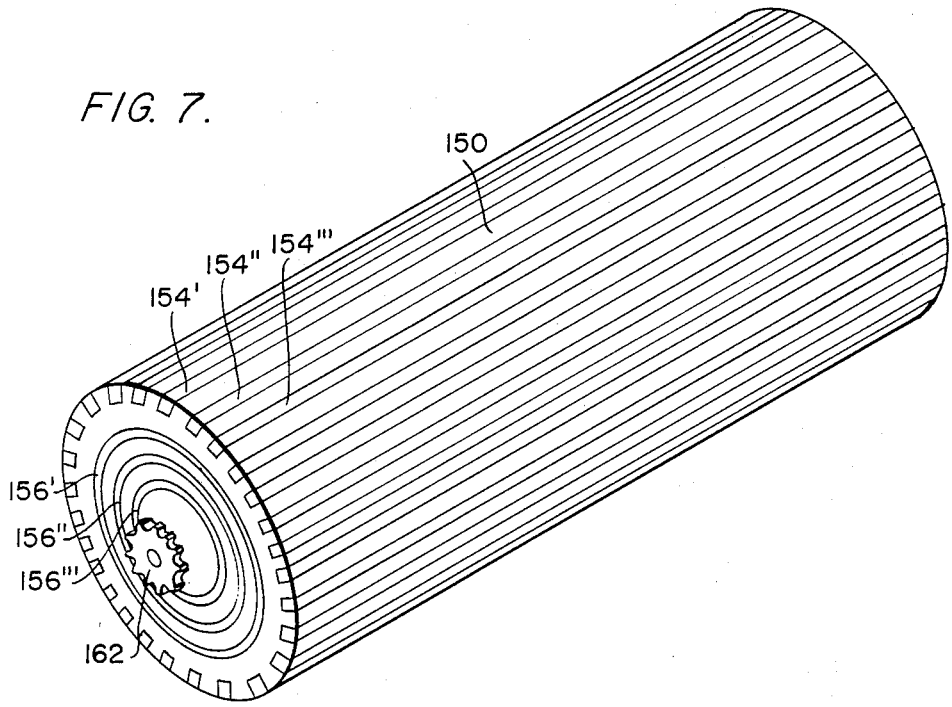
FIG. 7 is a three-dimensional view of the rotating drum of FIG. 6.

Another electrode arrangement 60'' which avoids the need for contact in the front face of the carpet is depicted FIGS. 6 and 7. In FIGS. 6 and 7, a cylindrical roller 150 of electrically insulative material is provided, as well as a suitable guide roller 152 for bringing the back side of the carpet 12 in contact with at least a portion of the cylindrical surface of the roll 150. Elongated electrodes 154', 154'' and 154''' are embedded at the cylindrical surface of the roll 150, in a manner similar to the electrodes of FIG. 5. In order to supply power to the electrodes 154', 154'', 154''', a commutator arrangement comprising commutator rings 156', 156'', and 156''' is mounted at one end of the roll 150, with suitable brushes 158', 158'', and 158''' making electrical contact with the collector rings 156', 156'', and 156'''.

Preferably, as the carpet 12 is advanced, the roll 150 is rotated in a direction and at a rotational velocity such that the cylindrical surface of the rolls moves in the same direction as and slightly faster than the carpet 12. This provides a wiping action to keep the roll clean and, at the same time, to ensure that all portions of the carpet web 12 are substantially uniformly treated. To accomplish this, as roll drive 160 is provided, comprising a sprocket 162 and a drive chain 164. Illustratively, the chain 164 is driven through a representative gearbox 166 which, it will be appreciated, may comprise an element of the FIG. 1 gearbox 30.

While the invention has been described above in the context of apparatus including only a single dye fixing station employing electrical conductivity, in accordance with the invention a dye fixing station employing electrical conductivity may be employed in combination with a steamer of conventional construction, but of greatly reduced length. For example, a steamer of conventional construction but only of thirty foot length (in contrast to the usual two hundred fifty foot length) may be employed ahead of a dye fixing station employing electrical conductivity in order to bring the carpet more gradually up to steaming temperature and, additionally, to partially fix the dye. Another advantage of this approach is that the dye may be partially fixed to the carpet surface, so as to avoid undue disturbance to the pattern and to even make possible the use of the flat-plate electrode arrangement with patterns.

In view of the foregoing it will be appreciated that by the present invention there is provided an entirely new approach to fixing dye in carpet processing, greatly advantageous compared to conventional steamers in terms of energy usage and floor space required.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A method for fixing to wet carpet dye applied in liquid form to the carpet, said method comprising physically and electrically contacting the wet carpet with electrodes in order to establish a conductive path, and passing through the wet carpet by means of the electrodes an electric current of sufficient magnitude to cause heating of the carpet and dye to a temperature sufficient to fix the dye to the carpet.

2. A method in accordance with claim 1, wherein the electric current is an AC current.

3. A method in accordance with claim 2, wherein the temperature to which the carpet and dye are heated is the boiling point temperature of the liquid dye.

4. A method in accordance with claim 1 wherein the temperature to which the carpet and dye are heated is the boiling point temperature of the liquid dye.

5. A method in accordance with claim 1, which comprises physically and electrically contacting the wet carpet with electrodes arranged for passing the electric current in a direction through the thickness of the carpet.

6. A method in accordance with claim 5, which further comprises continuously transporting a length of carpet through a dye fixing station at which the electric current is passed through the carpet.

7. A method in accordance with claim 1, which comprises physically and electrically contacting the wet carpet with electrodes arranged for passing the electric current in a direction generally parallel to a surface of the carpet.

8. A method in accordance with claim 7, which further comprises continuously transporting a length of carpet through a dye fixing station at which the electric current is passed through the carpet.

9. A method in accordance with claim 1, which further comprises continuously transporting a length of carpet through a dye fixing station at which the electric current is passed through the carpet.

10. A method for continuous treatment of a length of carpet material, said method comprising the steps of sequentially:

wetting the carpet with a dye-compatible liquid;

applying dye in liquid form to the carpet;

physcially and electrically contacting the wet carpet with electrodes in order to establish a conductive path; and passing through the wet carpet by means of the electrodes an electric current of sufficient magnitude to cause heating of the carpet and dye to a temperature sufficient to fix the dye to the carpet.

11. A method in accordance with claim 10, wherein the electric current is an AC current.

12. A method in accordance with claim 10, wherein the temperature to which the carpet and due are heated is the boiling point temperature of the liquid dye.

13. A method in accordance with claim 10, which further comprises ensuring that the dye-compatible wetting liquid and the liquid dye have sufficient electrical conductivity to pass the electric current.

14. A method in accordance with claim 13, wherein both the wetting liquid and the liquid dye are aqueous and include in the order of two grams per liter of a dissolved salt to enhance electrical conductivity.

15. A method in accordance with claim 10, which comprises:

applying dye to the carpet substantially uniformly to produce a solid color; and passing the electric current in a direction through the thickness of the carpet.

16. A method in accordance with claim 10, which comprises:

applying dye to the carpet to form a pattern; and applying electric current to the back side of the carpet such that the electric current flows in a direction generally parallel to a surface of the carpet and the pattern is substantially undisturbed.

17. Apparatus for fixing to wet carpet dye applied in liquid form to the carpet, said apparatus comprising at least a pair of electrodes disposed for physically and electrically contacting the wet carpet in order to establish a conductive path and arranged for connection to an electric power source so as to pass through the wet carpet an electric current of sufficient magnitude to cause heating of the carpet and dye to a temperature sufficient to fix the dye to the carpet.

18. Apparatus in accordance with claim 17, wherein said electrodes are arranged for connection to an AC electric power source.

19. Apparatus in accordance with claim 17, wherein said electrodes are disposed for physically and electrically contacting opposite surfaces of the carpet so as to pass the electric current in a direction through the thickness of the carpet.

20. Apparatus in accordance with claim 19, wherein said electrodes comprise a horizontally-disposed plate-like lower electrode arranged for supporting the carpet by the carpet back side, and a horizontally-disposed plate-like upper electrode opposite said lower electrode arranged for bearing against the front side of the carpet.

21. Apparatus in accordance with claim 20, wherein said upper electrode is arranged to bear against the carpet with a force equivalent to a weight in order of seven pounds per square foot.

22. Apparatus in accordance with claim 21, wherein said upper electrode comprises an aluminum plate in the order of one-half inch thick disposed so as to bear by the force of gravity on the carpet.

23. Apparatus in accordance with claim 22, which further comprises an upper plate support structure arranged to limit downward movement of said upper plate in the absence of carpet so as to prevent electrical contact between said upper and lower plates, and arranged to permit freely floating vertical movement of said upper plate in the presence of carpet so as to maintain physically and electrical contact of said upper plate with the carpet.

24. Apparatus in accordance with claim 17, which further comprises a driving arrangement for continuously advancing a length of carpet past said electrodes.

25. Apparatus in accordance with claim 24, wherein said electrodes are disposed for physically and electrically contacting opposite surfaces of the carpet so as to pass the electric current in a direction through the thickness of the carpet.

26. Apparatus in accordance with claim 24, wherein said electrodes are disposed for physically and electrically contacting the back surface of the carpet so as to pass the electric current in a direction generally parallel to a surface of the carpet.

27. Apparatus in accordance with claim 26, wherein said electrodes are elongated and embedded in a semi-cylindrical electrode support member over which the length of carpet is pulled.

28. Apparatus in accordance with claim 26, which further comprises:

a cylindrical roll of electrically insulative material and guides for bringing the back side of the carpet in contact with at least a portion of the cylindrical surface of said roll; and said electrodes being elongated and embedded at the cylindrical surface of said cylindrical roll parallel to the axis of said roll and circumferentially spaced from one another so as to pass the electric current in a direction generally parallel to a surface of the carpet.

29. Apparatus in accordance with claim 28, which further comprises a roll drive for rotating said cylindrical roll as the carpet is advanced.

30. Apparatus in accordance with claim 29, wherein said roll drive rotates said roll in a direction and at a rotational velocity such that the cylindrical surface of said roll moves in the same direction as and faster than the carpet.

31. Apparatus for continuous treatment of a length of carpet, said apparatus comprising:

a wet-out station for wetting the carpet with a dye-compatible liquid;

a dye applicator for applying dye in liquid form to the carpet;

a dye fixing station including at least a pair of electrodes disposed for physically and electrically contacting the wet carpet in order to establish a conductive path and arranged for connection to an electric power source so as to pass through the wet carpet an electric current of sufficient magnitude to cause heating of the carpet dye to a temperature sufficient to fix the dye to the carpet; and a driving arrangement for continuously advancing the length of carpet through said wet-out station, said dye applicator, and said dye fixing station.

32. Apparatus in accordance with claim 31, wherein the dye-compatible wetting liquid and the liquid dye have sufficient electrical conductivity to pass the electric current.

33. Apparatus in accordance with claim 32, wherein both the wetting liquid and the liquid dye are aqueous and include in the order of two grams per liter of a dissolved salt to enhance electrical conductivity.

34. Apparatus in accordance with claim 31 wherein:

said dye applicator is arranged so as to apply dye to the carpet substantially uniformly to produce a solid color; and wherein said electrodes of said dye fixing station are disposed for physically and electrically contacting opposite surfaces of the carpet so as to pass the electric current in a direction through the thickness of the carpet.

35. Apparatus in accordance with claim 34, wherein said electrodes comprise a horizontally-disposed plate-like lower electrode arranged for supporting the carpet by the carpet back side, and a horizontally-disposed plate-like upper electrode opposite said lower electrode arranged for bearing against the front side of the carpet.

36. Apparatus in accordance with claim 35, wherein said upper electrode is arranged to bear against the carpet with a force equivalent to a weight in order of seven pounds per square foot.

37. Apparatus in accordance with claim 36, wherein said upper electrode comprises an aluminum plate in the order of one-half inch thick disposed so as to bear by the force of gravity on the carpet.

38. Apparatus in accordance with claim 37, which further comprises an upper plate support structure arranged to limit downward movement of said upper plate in the absence of carpet so as to prevent electrical contact between said upper and lower plates, and arranged to permit freely floating vertical movement of said upper plate in the presence of carpet so as to maintain physical and electrical contact of said upper plate with the carpet.

39. Apparatus in accordance with claim 31, wherein:

said dye applicator is arranged so as to apply dye to the carpet in a pattern; and wherein said electrodes of said dye fixing station are disposed for physically and electrically contacting the back surface of the carpet so as to pass the electric current in a direction generally parallel to a surface of the carpet.

40. Apparatus in accordance with claim 39, wherein said electrodes are elongated and embedded in a semi-cylindrical electrode support member over which the length of carpet is pulled.

41. Apparatus in accordance with claim 39, wherein:

said dye applicator is arranged so as to apply dye to the carpet in a pattern; and wherein said dye fixing station comprises a cylindrical roll of electrically insulative material, guides for bringing the back side of the carpet in physical contact with at least a portion of the cylindrial surface of said roll, and said electrodes being elongated and embedded at the cylindrical surface of said cylindrical roll parallel to the axis of said roll and circumferentially spaced from one another so as to pass the electric current in a direction generally parallel to a surface of the carpet and to avoid disturbing the pattern.

42. Apparatus in accordance with claim 41, which further comprise a roll drive for rotating said cylindrical roll as the carpet is advanced.

43. Apparatus in accordance with claim 42, wherein said roll drive rotates said roll in a direction and at a rotational velocity such that the cylindrical surface of said roll moves in the same direction as and slightly faster than the carpet.

* * * * *